United States Patent [19]

Giulie

[11] 4,309,046

[45] Jan. 5, 1982

[54] BINDING ELEMENT

[75] Inventor: Joe D. Giulie, Palo Alto, Calif.

[73] Assignee: Minnesota Mining and Manufacturing Company, St. Paul, Minn.

[21] Appl. No.: 812,054

[22] Filed: Jul. 1, 1977

[51] Int. Cl.[3] ..... B42D 1/00

[52] U.S. Cl. ..... 281/21 R; 281/25 R; 402/63; 402/68

[58] Field of Search ..... 281/21 R, 25 R; 402/62, 402/63, 68; 85/5 M, 7, 13, 23, 21; 151/7, 41.7–41.76; 403/283, 284

[56] References Cited

U.S. PATENT DOCUMENTS

| | | | |
|---|---|---|---|
| 1,845,671 | 2/1932 | Lotter | 281/25 R |
| 2,381,204 | 8/1945 | Cardoza | 402/63 |
| 3,340,635 | 9/1967 | McIntosh | 281/21 R X |
| 3,800,653 | 4/1974 | Barth et al. | 85/13 |
| 3,879,783 | 4/1975 | Giulie | 281/21 R X |
| 3,920,338 | 11/1975 | Dahl | 151/41.74 X |
| 3,970,331 | 7/1976 | Giulie | 281/21 R |

*Primary Examiner*—Frank T. Yost

*Attorney, Agent, or Firm*—Cruzan Alexander; Donald M. Sell; William L. Huebsch

[57] ABSTRACT

A binding element adapted for binding an apertured stack of sheets into a book. The binding element comprises a first binding strip from which project a plurality of spaced studs adapted to be positioned through the apertures; and a second binding strip having a plurality of openings sized to freely receive the studs to afford positioning the second strip over ends of the studs projecting beyond the stack of sheets. Blocks on the second strip can then be pressed into the openings to forcefully engage the studs extending through the openings with teeth along the walls of the openings so that the teeth will indent the studs and maintain the position of the studs in the second strip. The ends of the studs projecting beyond the second strip can then be removed.

10 Claims, 14 Drawing Figures

FIG. 1
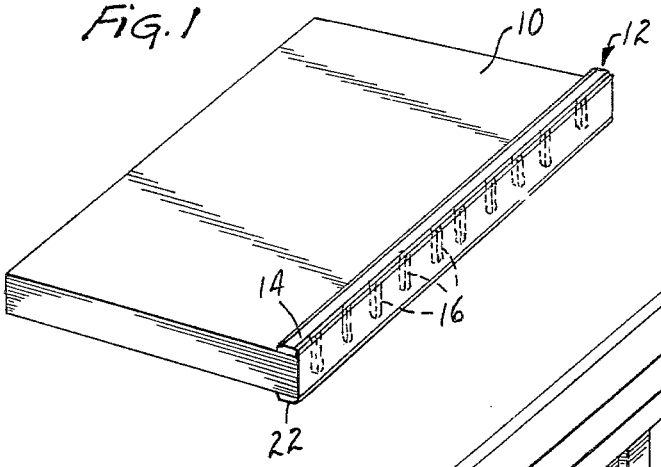
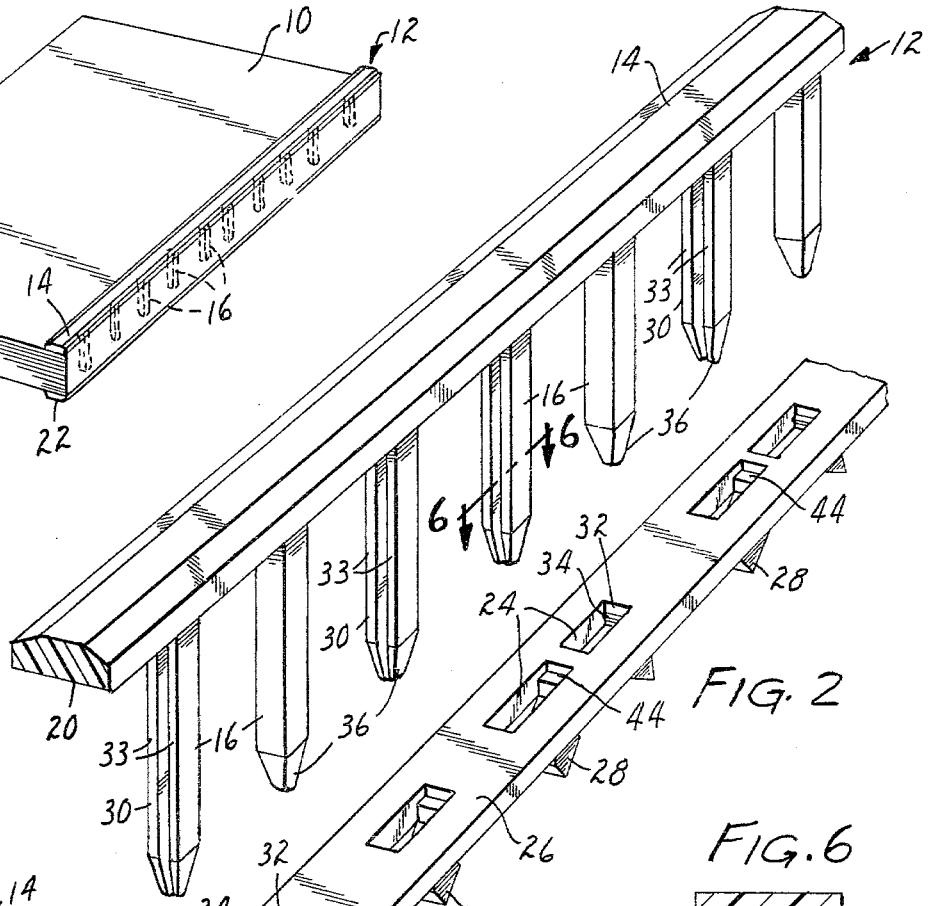
FIG. 2
FIG. 3
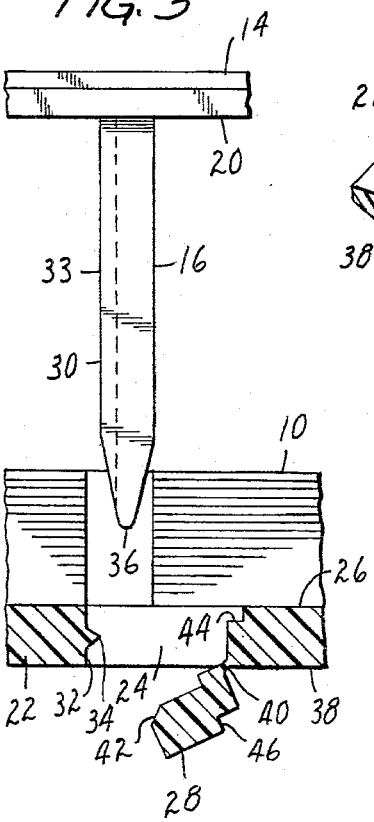
FIG. 4
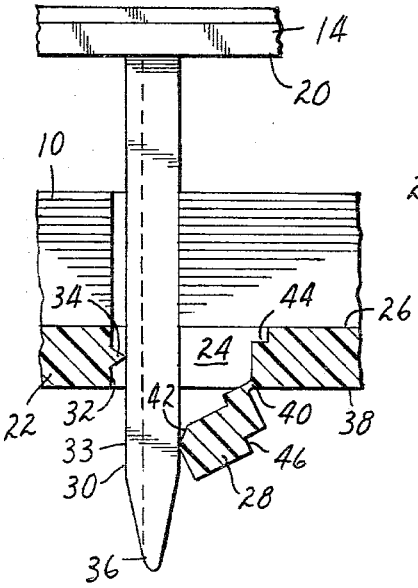
FIG. 6
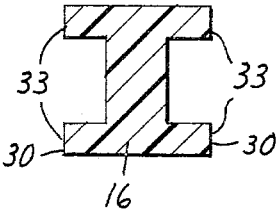
FIG. 5
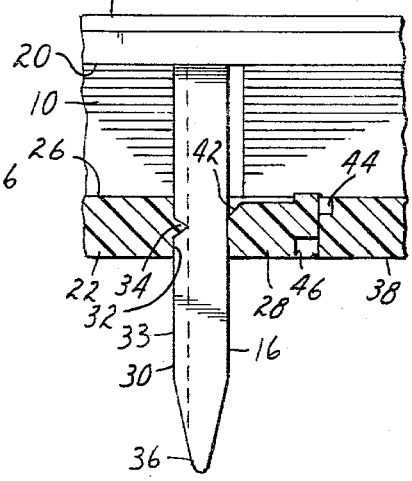

BINDING ELEMENT

BACKGROUND OF THE INVENTION

The present invention relates to polymeric binding elements adapted for permanently binding apertured stacks of paper.

U.S. Pat. No. 3,596,929 and my U.S. Pat. No. 3,970,331 describe two different types of inexpensive molded polymeric binding elements presently in use for permanently binding together apertured stacks of paper. Both comprise a first binding strip from which project a plurality of spaced studs adapted to be positioned through the apertures in the stack with the first binding strip adjacent one surface of the stack, and a second binding strip having spaced openings adapted to freely receive the studs. The second binding strip can be positioned over and locked in engagement with the ends of the studs projecting beyond the apertured stack of sheets to bind the stack. The studs of the binding element described in U.S. Pat. No. 3,596,929 are locked in engagement with the second strip by heat forming enlarged heads on the studs, whereas the studs on the binding element described in my U.S. Pat. No. 3,970,331 are locked to the second strip by pressing blocks into the openings to engage ratchet teeth on the studs with teeth on the second strip projecting into the openings.

The device required for forming heads on the studs of the binding element described in U.S. Pat. No. 3,596,929 includes electrical heaters which must be specially protected to prevent a fire hazard, particularly in the presence of paper chaff where, as has been done, the heating and forming device is combined with a machine for punching apertures in a stack of paper (see U.S. Pat. No. 3,756,625). Also the device can only be used where a source of electrical power is available.

While the binding element described in my earlier U.S. Pat. No. 3,970,331 can be attached to a stack of paper by an entirely mechanical device, thereby eliminating the problems associated with electrical heaters (see my U.S. Pat. No. 3,879,783), the mold required to form the ratchet teeth on the binding element is more complex than might otherwise be desired.

SUMMARY OF THE INVENTION

The present invention provides a polymeric binding element for permanently binding an apertured stack of sheets into a book, which binding element can have studs of a simple design projecting from one binding strip and can be permanently attached to an apertured stack of paper by an entirely mechanical binding device.

According to the present invention there is provided a polymeric binding element generally the type described in my U.S. Pat. No. 3,970,331 for permanently binding an apertured stack of sheets into a book. Like the binding element described in my U.S. Pat. No. 3,970,331 the binding element according to the present invention comprises a first elongate strip having a contact surface adapted to engage one surface of the stack of sheets, and a plurality of spaced elongate studs projecting normally from the contact surface adapted to be positioned through the apertures in the stack of sheets. Also included is a second elongate mating strip having an engaging surface adapted to engage the stack of sheets on its surface opposite the first strip and an outer surface opposite the engaging surface. Walls between the engaging and outer surfaces define a plurality of openings in the second strip of a size larger than the cross sections of the studs and spaced to freely receive the studs with the strips assembled about the stack of sheets. The second strip includes a plurality of blocks adapted to be pressed into the openings to engage locking surfaces on the sides of the studs opposite the blocks with adjacent locking surfaces on the second strip. In the present invention, however, instead of the locking surfaces of a mating stud and wall being formed by interacting ratchet teeth, one of the locking surfaces is formed by at least one tooth and the other of the locking surfaces is free of teeth and is adapted to be deformed by the tooth to hold the stud in the opening when the locking surfaces are brought into forceful engagement by the block being pressed into the opening.

Preferably the teeth are part of the second strip, which simplifies the molding of the binding element in that a lesser amount of teeth must be provided than would be required if the teeth were formed along the studs.

While the teeth can be caused to deform flat continuous locking surfaces, preferably the locking surfaces to be deformed are defined by one or more ribs oriented parallel to the studs projecting through the openings and having widths less than those of the studs or openings so that material displaced when the teeth indent the ribs can move into openings or grooves adjacent the ribs, thereby reducing the force required to engage the locking surfaces.

BRIEF DESCRIPTION OF THE DRAWING

The invention will be further described with reference to the accompanying drawing where like numbers refer to like parts in the several views, and wherein:

FIG. 1 is a perspective view of an apertured stack of sheets bound with a binding element according to the present invention;

FIG. 2 is an enlarged fragmentary view of the binding element of FIG. 1;

FIGS. 3, 4 and 5 are enlarged fragmentary sectional views sequentially illustrating the attachment of the binding element of FIG. 1 to an apertured stack of sheets;

FIG. 6 is an enlarged sectional view taken approximately along line 6—6 of FIG. 2;

DESCRIPTION OF THE PREFERRED EMBODIMENT

Figure 7:
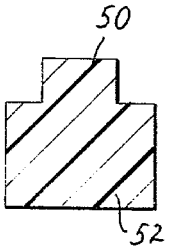
FIGS. 7 through 11 are cross sectional views illustrating alternate shapes of studs that may be included in binding elements according to the present invention.

Referring now to the drawing there is shown in FIG. 1 an apertured stack of paper sheets 10 bound into a book by a binding element 12 according to the present invention.

Briefly, as is best seen in FIGS. 2 through 5, the binding element 12 comprises a first strip 14 from which project a plurality of spaced studs 16 which may be inserted through the apertures in the stack of sheets 10 so that a contact surface 20 on the first strip 14 is adjacent one surface of the stack of sheets 10. A second strip 22, having a length and width substantially corresponding to the length and width of the first strip, has walls defining openings 24 for freely receiving the spaced studs 16 with an engaging surface 26 on the second strip 22 contacting the surface of the stack of sheets 10 opposite that contacted by the first strip 14. Blocks 28 can be pressed into the openings 24 after the studs 16 are inserted therein (FIG. 5) to press locking surfaces 30 on the sides of the studs 16 opposite the blocks 28 forcefully into engagement with adjacent locking surfaces 32 on the walls defining the openings 24 through the second strip 22. Such forceful engagement causes the locking surface 30 on each of the studs 16 (which locking surface 30 is defined by parallel longitudinally extending ribs 33) to be indented or deformed by a tooth 34 partially defining the adjacent locking surface 32 in the second strip 22 to lock the first and second strips 14 and 22 in permanent engagement and bind the stack of apertured sheets 10.

The first strip 14 is an elongate member, having a length adapted to extend entirely along one side of the stack of sheets 10. Preferably the first strip is integrally molded with the studs 16 of a tough flexible polymeric material such as the terpolymer acrylonitrile-butadiene-styrene (ABS). The studs 16 project in a direction normal to the contact surface 20 and are spaced and have uniform generally rectangular cross section sized so that they will freely enter the perforations in the stack of sheets 10. Also the studs 16 have generally pointed terminal ends 36 which aid in inserting the studs 16 into the perforations in the stack of sheets 10 and the openings 24 in the second strip 22. The studs 16 are longitudinally grooved to provide two parallel ribs 33 along each stud 16, each rib 33 being generally of a rectangular cross section. The groove between the ribs provides a space into which may move the material of the ribs 33 which is displaced by indentation of one of the teeth 34. The ribs 33 on each two adjacent studs 16 face opposite ends of the first strip 14. This allows any bending forces on the first and second strips 14 and 22 which result from locking the studs 16 to the second strip via the blocks 28 to affect only the portions of the strips 14 and between adjacent studs 16, thereby tending to neutralize the effect of such bending forces over the length of the strips 14 and 22. When, as illustrated, an odd number of studs 16 is used, ribs 33 are formed on both sides of the central stud 16 (FIG. 6) to afford mating of the first and second strips 14 and 22 with either of their ends adjacent.

The second strip 22 also is preferably molded of a tough flexible polymeric material such as ABS and has a length adapted to extend entirely along one side of the stack of sheets 10. The walls of the second strip 22 defining the openings 24 extend from its engaging surface 26 to an opposite outer surface 38. The blocks 28 (which are integrally molded with the second strip 22) are mounted to the second strip 22 at its outer surface 38 in a position adjacent and projecting over the opening 24 by a thin web 40 of the polymeric material. The blocks 28 may be pressed from their initial positions outside the openings 24 and projecting above the outer surface 38 (FIGS. 2 and 3) to lock positions entirely within the openings 24 (FIG. 5), during which pressing the webs 40 are fractured to afford movement of the blocks 28. Each block 28 has a thickness about the same as that of the second strip 22 and a length along the second strip 22 adapted to press the projecting tooth 34 entirely into the ribs 33 on one of the studs 16 in the adjacent opening 24 when the block 28 is moved to its lock position within that opening 24.

Preferably each block 28 has a beveled edge 42 adjacent the outer surface 38 and the locking surface 32 so that the block 28 will not be excessively pivoted away from the locking surface 32 by a stud 16 passing through the adjacent opening 24, but will remain in a suitable position to be pressed into that opening 24. Also preferably the second strip 22 is relieved at the edge of each opening 24 adjacent its engaging surface 26 and opposite its locking surface 32 to provide grooves 44 and the blocks 28 are relieved at their edges diagonally opposite their beveled edges 42 to provide grooves 46. The grooves 46 on the blocks 28 will receive fragments of the web 40 remaining on the second strip 22 and the grooves 44 on the second strip 22 will receive fragments of the web 40 remaining on the blocks 28 after the blocks 28 have been pressed into the openings 24.

The binding element 12 may be advantageously applied to the stack of paper 10 through the use of a binding device or machine described in U.S. Pat. No. 3,879,783, the content whereof is incorporated by reference herein.

The projecting tooth 34 in each opening 24 has a generally right triangular cross section and extends the full width transversely across the opening 24 at a position about centrally spaced between the engaging surface 26 and the outer surfaces 38. In addition to one of the teeth 34, each locking surface 32 is also defined by planar portions of the walls on both sides of the tooth 34. These planar portions engage the locking surfaces of the ribs 33 to help maintain the alignment of the studs 16 normal to the engaging surface 26 after the teeth 34 have engaged the ribs 33, thereby restricting bending torques on the strips 14 and 22.

Figure 8:
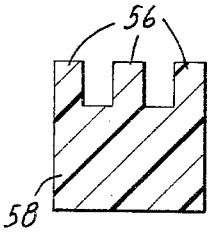
Figure 9:
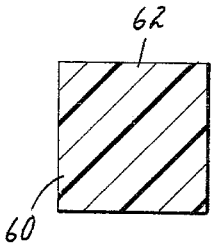
Figure 10:
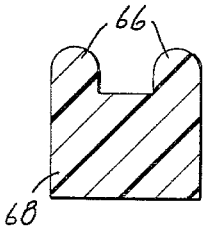
Figure 11:
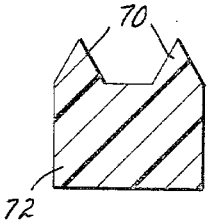

The binding element 12 illustrated in FIGS. 1 through 6 illustrates but one preferred embodiment of a binding element according to the present invention. Many changes may be made in the structure of the binding element 12 within the scope of the present invention. For example, its studs may be provided with any number of ribs, such as with one rib 50 as illustrated in cross section in FIG. 7 for a stud 52; or with the three ribs 56 as illustrated in cross section in FIG. 8 for a stud 58; or even with no ribs as illustrated in cross section in FIG. 9 for a stud 60 wherein a continuous surface 62 of the stud is indented by the tooth. Also, its ribs may have other than a rectangular cross section such as a generally semi-circular cross section as is illustrated in cross section in FIG. 10 for ribs 66 on a stud 68; or a triangular cross section as is illustrated in cross section in FIG. 11 for ribs 70 on a stud 72.

Figure 12:
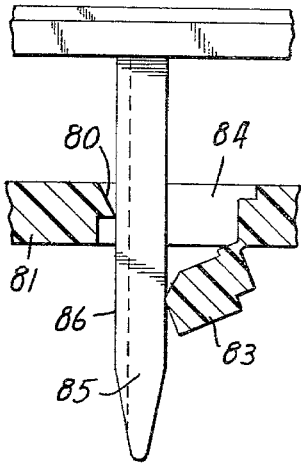
FIG. 12 is a fragmentary sectional view of another alternate embodiment of a binding element according to the present invention.

Additionally, the configuration of the tooth on the first strip may be varied considerably, such as by using more than one tooth, or, as illustrated in FIG. 12, using a tooth 80 in a second strip 81 having a configuration similar to that of the tooth 41 on the backing strip 19 described in my U.S. Pat. No. 3,970,331 (the content whereof is incorporated herein by reference); and including a block 83 similar to the block 28 of the binding element 12 adapted for movement into an opening 84 to press a stud 85 similar to the stud 16 of the strip 14 against the tooth 80 to indent ribs 86 on the stud 85.

Figure 13:
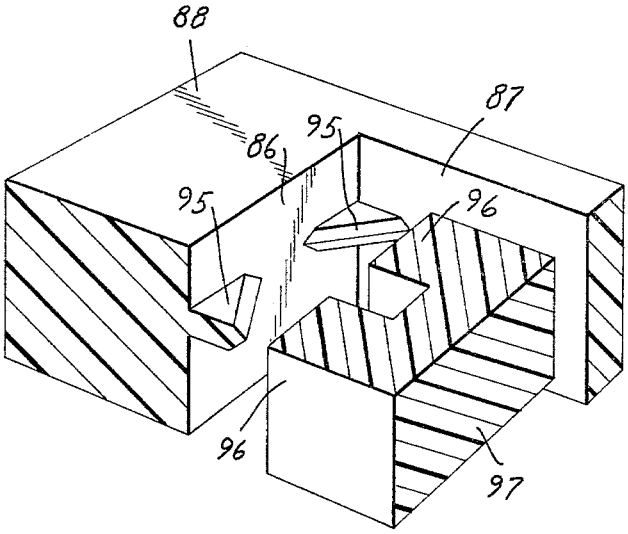
FIG. 13 is a fragmentary sectional view in perspective of another alternate embodiment of a binding element according to the present invention.

FIG. 13 illustrates an alternate embodiment for a binding element according to the present invention in which a locking surface 86 in a rectangular opening 87 in a second strip 88 is partially defined by two teeth 95 each extending across a corner of the opening 87. The teeth 95 are positioned to engage across corners of longitudinally extending ribs 96 on a stud 97 positioned therein, which stud 97 is of essentially the same configuration as the studs 16 of the binding element 12.

Figure 14:
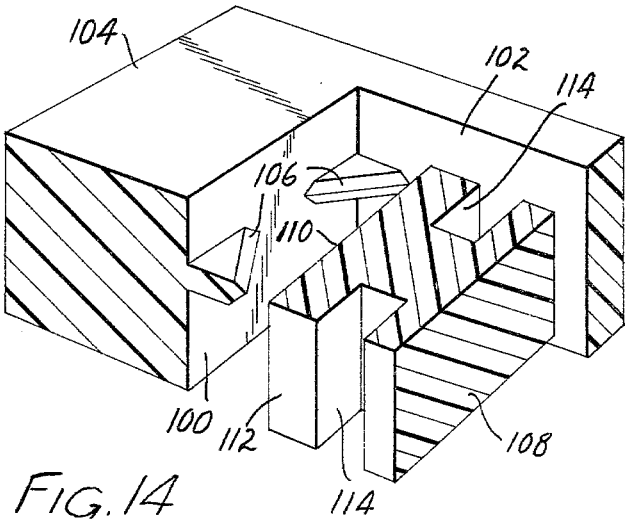
FIG. 14 is a fragmentary sectional view of yet another alternate embodiment of a binding element according to the present invention.

FIG. 14 illustrates yet another alternate embodiment in which a locking surface 100 in a rectangular opening 102 in a second strip 104 is partially defined by two teeth 106 each extending across a corner of the opening 102 in the manner of the teeth 95 in the embodiment illustrated in FIG. 13. The embodiment illustrated in FIG. 14, however, has a stud 108 differing in configuration from the stud 97 of the binding element illustrated in FIG. 7 in that the stud 108 has a locking surface 110 defined by a single rib 112, and has two longitudinal grooves 114 in its side surfaces 110. The grooves 114 are adapted to receive material of the rib 112 displaced by engagement with the teeth 106 when a block is pressed into the opening 102.

It will be appreciated that other configurations for the strips would also be suitable, such as a second strip having a larger number of teeth partially defining its locking surface (which teeth may be of a smaller size to facilitate engagement) or a second strip having ribs along its locking surface adapted to mate with a first strip having teeth along its studs. Also the binding element may use blocks that pivot into the openings such as are illustrated in FIGS. 12, 13 and 14 of U.S. Pat. No. 3,970,331. Thus, the scope of the invention should not be limited by the disclosure herein but only by the scope of the dependent claims.

I claim:

1. A binding element adapted for binding an apertured stack of paper into a book, said binding element comprising:

a first elongate strip having a contact surface along one side adapted to engage the surface of a said stack of paper;

a plurality of spaced elongate studs projecting normally from the contact surface of said first strip;

a second elongate mating strip having a length substantially corresponding to the length of the first strip, an engaging surface along one side adapted to engage a said stack of paper, an outer surface opposite said engaging surface, and walls between said engaging surface and said outer surface defining a plurality of openings through said second strip of sizes larger than the cross section of said studs and spaced to freely receive said studs; and a plurality of blocks, each of said blocks being mounted by a thin web to said second strip at said outer surface along a different one of said openings and being adapted to be pressed into the adjacent opening to force a stud therein against the wall of the opening opposite the block to forcefully engage adjacent locking surfaces therebetween;

one of said locking surfaces being partially defined by at least one tooth and the other of said locking surfaces being free of teeth and being defined by at least one longitudinally extending rib, which rib is deformable by said tooth when said locking surfaces are brought into forceful engagement by said blocks.

2. A binding element according to claim 1, wherein said tooth partially defines the locking surface on said wall of the opening opposite the block, said tooth being spaced within said opening from said outer surface.

3. A binding element according to claim 1, wherein said thin webs are adapted to be fractured as said blocks are pressed into said openings.

4. A binding element adapted for binding an apertured stack of paper into a book, said binding element comprising:

a first elongate strip having a contact surface along one side adapted to engage the surface of a said stack of paper;

a plurality of spaced elongate studs projecting normally from the contact surface of said first strip;

a second elongate mating strip having a length substantially corresponding to the length of the first strip, an engaging surface along one side adapted to engage a said stack of paper, an outer surface opposite said engaging surface, and walls between said engaging surface and said outer surface defning a plurality of openings through said second strip of sizes larger than the cross section of said studs and spaced to freely receive said studs; and a plurality of blocks, each of said blocks being mounted by a thin web to said second strip at said outer surface along a different one of said openings and being adapted to be pressed into the adajcent opening to force a stud therein against the wall of the opening opposite the block to forcefully engage adjacent locking surfaces therebetween;

the locking surfaces on the walls of the openings each being partially defined by at least one tooth and the locking surfaces on the studs being free of teeth and being deformable by said tooth when said locking surfaces are brought into forceful engagement by said blocks, and said studs each having at least one longitudinally extending groove adapted to receive material displaced by engagement of said tooth.

5. A binding element adapted for binding an apertured stack of paper into a book, said binding element comprising in combination:

a first elongate strip having a contact surface along one side adapted to engage the surface of a said stack of paper;

a plurality of spaced elongate studs projecting normally from the contact surface of said first strip, each of said studs having at least one longitudinally extending rib along one side;

a second elongate mating strip having a length and width substantially corresponding to the length and width of the first strip, an engaging surface along one side adapted to engage a said stack of paper, an outer surface opposite said engaging surface, walls between said engaging surface and said outer surface defining a plurality of openings through said second strip of sizes larger than the cross sections of said studs and spaced to freely receive said studs, one of the walls in each of said openings having a tooth spaced from said outer surface, the teeth in said openings being positioned adjacent the ribs on said studs when said studs are positioned in said openings; and a plurality of blocks, each of said blocks being mounted by a thin web to said second strip along a different one of said openings at its edge opposite the tooth therein, said blocks being adapted to be pressed into said openings to displace said studs and force the ribs against the teeth so that the ribs will be deformed and engaged by the teeth.

6. A binding element according to claim 5, wherein said thin webs are adapted to be fractured as said blocks are pressed into said opening.

7. A binding element according to claim 5, wherein there is an odd number of studs and the center stud has longitudinally extending ribs along both sides thereof adjacent the ends of said first strip.

8. A binding element according to claim 5, wherein the ribs on each two adjacent studs face opposite ends of said first strip.

9. A binding element according to claim 5, wherein each of said studs has two parallel longitudinally extending ribs along said one side.

10. A binding element according to claim 5, wherein said studs each have at least one longitudinally extending groove adjacent said rib, the grooves of said ribs being adapted to receive displaced material of said studs when said teeth engage said ribs.

* * * * *